US006163897A

United States Patent [19]

Plas et al.

[11] Patent Number: 6,163,897

[45] Date of Patent: Dec. 26, 2000

[54] SELF-ADJUSTING CONTROL DEVICE FOR FLUSHING SYSTEM MECHANISM

[75] Inventors: Olivier Plas, Menton; Philippe Greco, Nice, both of France

[73] Assignee: Siamp Cedap, Monaco, Monaco

[21] Appl. No.: 09/402,822

[22] PCT Filed: Apr. 10, 1998

[86] PCT No.: PCT/FR98/00726

§ 371 Date: Dec. 3, 1999

§ 102(e) Date: Dec. 3, 1999

[87] PCT Pub. No.: WO98/46836

PCT Pub. Date: Oct. 22, 1998

[30] Foreign Application Priority Data

Apr. 11, 1997 [FR] France ..... 97 04475

[51] Int. Cl.[7] ..... E03D 5/09

[52] U.S. Cl. ..... 4/410

[58] Field of Search ..... 4/405, 410

[56] References Cited

U.S. PATENT DOCUMENTS 5,265,282 11/1993 Schmucki ..... 4/410 X

FOREIGN PATENT DOCUMENTS 0311542 4/1989 European Pat. Off. ..... 4/405
2 548 328 1/1985 France .
2 719 858 11/1995 France .

*Primary Examiner*—Charles E. Phillips
*Attorney, Agent, or Firm*—Young & Thompson

[57] ABSTRACT

A self-adjusting control device for a flushing system mechanism borne by a stirrup and provided with pivoting arms actuated by fingers borne by pull-handles for flushing the water, the water flush control being provided via rods acting on the head of the pivoting arms, by externally accessible control knobs on the water flushing apparatus lid. The device comprises: a housing (16) containing the control knobs (19, 20), provided with a thread pitch (p1); an insert (14), integral in rotation with the housing (16) provided with a thread pitch (p2); a fitting (25) borne by the insert (14) carries the pivoting axis (26) of the arms (10, 11); the thread pitches (p1, p2) are in the ratio p1/p2 =L1/L2 of the vertical projections of the distances from the axis of the finger (33, 34) (L1) to the contact points (31, 32) of the heads (29, 30) of the arms (10, 11) and the rods (21, 22), and (L2) to the pivoting axis (26) of the arms (10, 11).

4 Claims, 5 Drawing Sheets

SELF-ADJUSTING CONTROL DEVICE FOR FLUSHING SYSTEM MECHANISM

CROSS-REFERENCE TO RELATED APPLICATION

This is the 35 USC 371 national stage of international application PCT/FR98/00726 filed on Apr. 10, 1998, which designated the United States of America.

FIELD OF THE INVENTION

The invention refers to a self-adjustable control device for a cistern flushing mechanism, and especially to such a mechanism for a ceramic cistern, a flush control being provided by a button placed on the cistern's lid.

BACKGROUND OF THE INVENTION

In ceramic cisterns, cistern elevations and lid elevations are likely to change from one cistern to another. Generally, variations in elevation are of a few millimeters but may be in excess of tens of millimeters.

Usually, pre-adjustment of the elevation of the flushing mechanism is carried out by using the bracket which connects the upper part of the mechanism bearing the control button, and the lower part bearing the valve. This bracket includes two vertical arms provided with teeth regularly distributed on the arm's elevation generally with a 15 mm step. It happens that a pre-adjustment carried out by means of the bracket's teeth brings the control button exactly to the elevation of the top of the lid of the ceramic cistern.

However, usually the control button's position has to be adjusted. This adjustment is carried out by removing the control button and by cutting with an appropriate tool the vertical rod imparting the control pressure to the swivelling arm which provides, via a pull handle, for opening of the valve. The control button is then put back into place.

The technical problem posed by the adjustment of the control button's position is critical in the case of a flushing mechanism capable of providing two flushes of different volumes by means of two buttons placed side by side. The two vertical rods must then be cut to the same elevation, if either of them is cut too short, it must be replaced. That is why in the proposed assemblies for fitting to cisterns, flushing mechanisms are accompanied by several, generally four or five, rods.

SUMMARY OF THE INVENTION

One of the objects of the invention is to propose a flushing mechanism wherein no intervention on the vertical rods providing control is required for adjusting of the control button's position.

Another object of the invention is to propose a flushing mechanism wherein adjustment of the control button's position is performed simply by manual screwing.

Still another object of the invention is to propose a flushing mechanism wherein the control button's orientation is not linked to the position of the mechanism in the cistern.

The object of the invention is a self-adjustable device for controlling a cistern mechanism supported by a bracket and provided with swivelling arms capable, by acting on fingers provided on pull handles, of triggering the flushing, control of the flushing being provided, via rods acting on the head of the swivelling arms, by control buttons accessible from outside on the lid of the cistern, characterized in that it includes:

a casing containing control buttons and provided with a thread of pitch p1 at its lower part, a socket rotatably integral with said casing and provided with a thread of pitch p2, a frame supported by said socket and supporting the axis of rotation of said swivelling arms, thread pitches p1 and p2 being determined in the ratio p1/p2=L1/L2 of the vertical projections of the distances (L1, L2) from the axis of said fingers on the one hand to the contact positions of the heads of the swivelling arms and of said rods, and on the other hand to the axis of rotation of the swivelling arms, the bracket supporting a threaded sleeve with thread pitch p1 and a threaded ring with thread pitch p2, in such a way that screwing in of the casing until it rests against the cistern's lid automatically provides adjustment of the position of the axis of rotation of the swivelling arms for providing control of the flushing without adjustment of the length of the rods.

According to other features:

the socket is made such as to be rotatably integral with the casing by keying;

the frame is supported by the socket via a flange positioned at the lower part of the socket and on which the frame slides upon rotation of the socket;

the casing bears at its upper part a supporting flange on the cistern's lid.

BRIEF DESCRIPTION OF THE DRAWINGS

Other features will be apparent from the following description with reference to the accompanying drawings wherein.

DETAILED DESCRIPTION OF THE INVENTION

Figure 1:
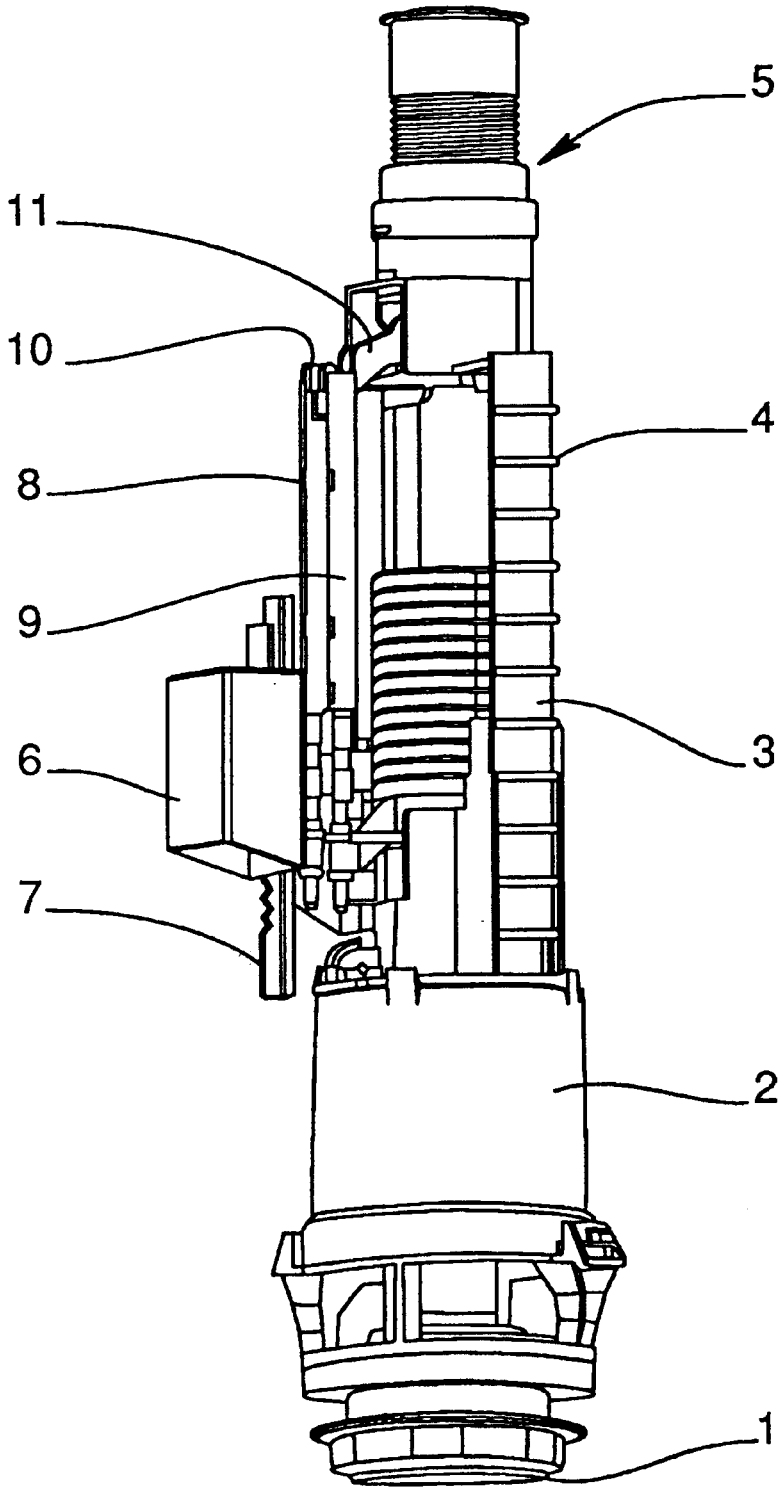
FIG. 1 is an overview of a flushing mechanism including the self-adjustable control device according to the invention.

In FIG. 1, a flushing mechanism is illustrated in its entirety, with a valve 1, a bell 2, a bracket 3 the vertical arms of which are provided with teeth 4 for pre-adjustment in elevation, a control device 5, a float 6, a rocker 7, two pull handles 8, 9 for controlling the opening of the valves corresponding to a full flush and to a partial flush, respectively, and two swivelling arms 10, 11 for lifting the pull handles 8, 9, respectively, on manual actuation of the corresponding push-buttons.

Figure 2:
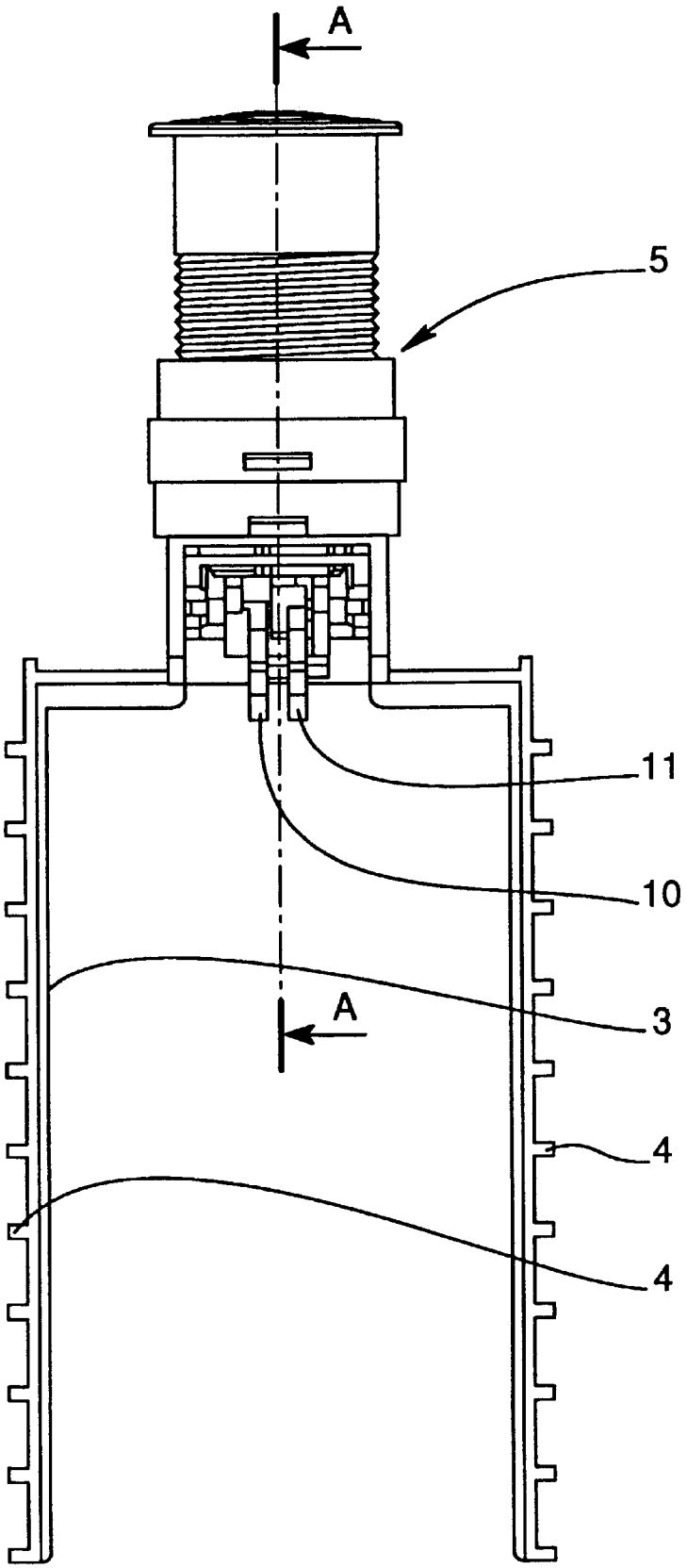
FIG. 2 is a front view of the self-adjustable control device according to the invention.

In FIG. 2, the control device is designated by the general reference number 5, the bracket is shown with its two vertical arms supporting each of the teeth 4 for pre-adjustment in elevation, and two swivelling arms 10 and 11 are shown without the pull handles 8, 9.

Figure 3:
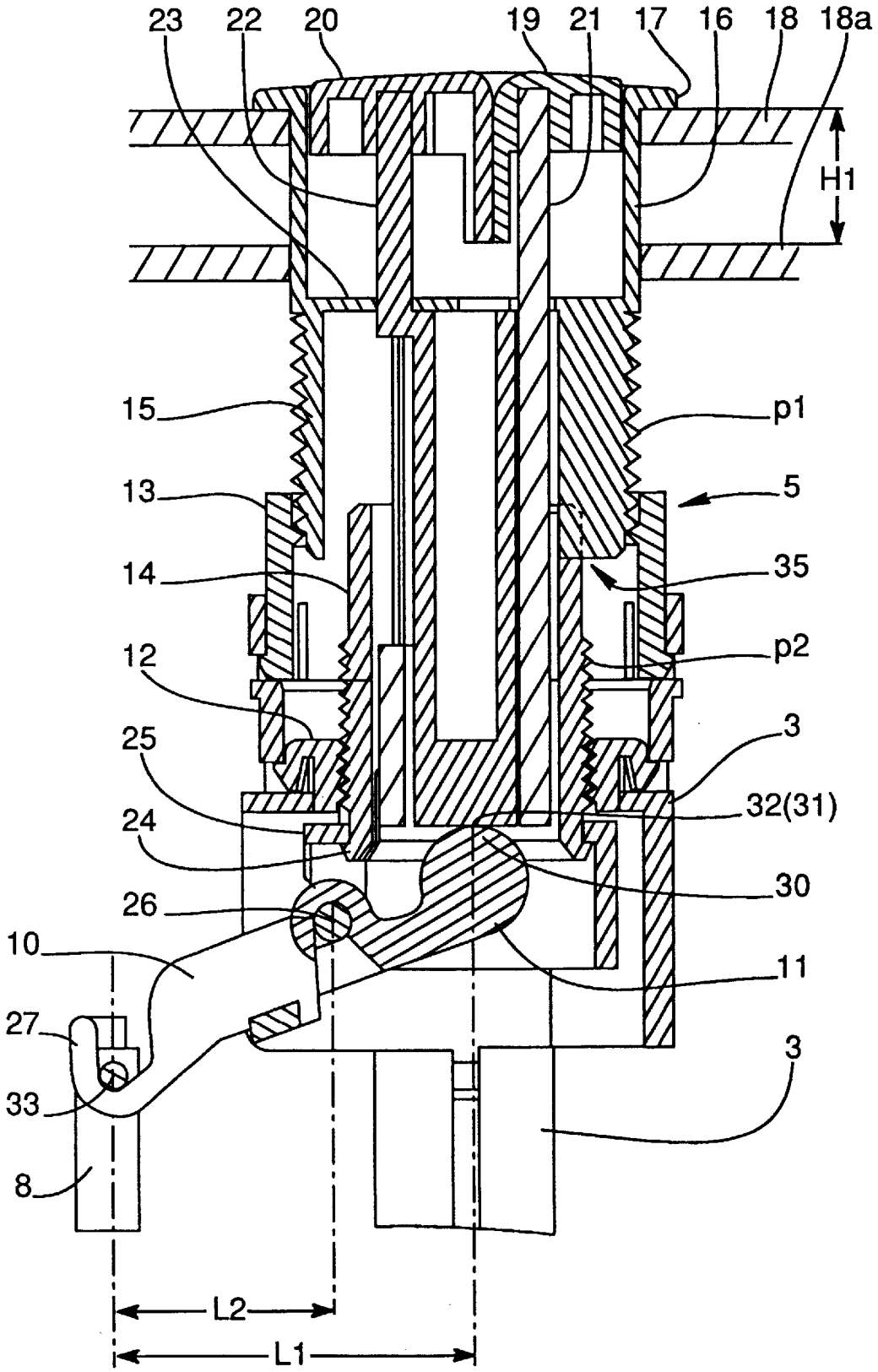
FIG. 3 is a sectional view along line AA of FIG. 2, at an enlarged scale.

In FIG. 3, an example of an embodiment of the control device 5 of the flushing mechanism is shown, according to the invention. Bracket 3, the position of which is fixed relatively to the cistern, supports a threaded ring 12 and a threaded sleeve 13, also fixed relatively to the cistern.

Inside the threaded ring 12, a socket 14 is positioned which includes a thread with pitch p2 matching the threaded ring 12. The lower part 15 of a casing 16 is positioned within the threaded sleeve 13. This lower part 15 is threaded with a thread pitch p1 matching that of the threaded sleeve 13.

The upper part of the casing 16 includes a flange 17 provided for lying on the ceramic lid 18 of the cistern. The upper part of the casing 16 has the shape of a cylindrical cup and it contains two flush buttons 19 and 20, which control full flushing and partial flushing respectively.

Control button 19 for full flushing bears a rod 21 the lower part of which has the shape of a tube and may move without friction within socket 14. Control button 20 for partial flushing supports a rod 22 the lower part of which is at the same level as the lower part of rod 21 supported by button 19, and it slides within the lower part of rod 21. Both rods 21 and 22 cross the bottom 23 of the cup forming the upper part of casing 16, by passing through apertures so as to be free to move axially, but both are rotatably integral with casing 16.

At the lower part, socket 14 exhibits a flange 24 on which lies a frame 25 supporting the axis 26 of rotation of swivelling arms 10, 11.

Frame 25 moves with socket 14 axially, but it slides on flange 24 and does not follow the rotary movement of socket 14, so that axis 26 moves axially, remaining parallel to itself.

Each of arms 10, 11 exhibit at their lower ends a hook, 27, 28 respectively, on which hangs a pull handle 8, 9 respectively. At their upper ends, arms 10, 11 exhibit a head 29, 30 respectively which abut under the lower end of rods 21, 22 respectively, in abutment positions 31, 32 respectively.

Pull handles 8, 9 bear at their upper ends a finger 33, 34 respectively, for hanging them on hooks 27, 28 respectively.

For a specific swivelling arm, for example, 10, finger 3, axis 26 and abutment position 31 are aligned, and in a vertical projection, the distance from the centre of the finger 33 to the centre of axis 26 is L2, and the distance from centre of finger 33 to abutment position 31 is L1.

Mounting the flushing mechanism in a ceramic cistern is carried out by pre-adjusting the elevation by means of teeth 4 of bracket 3, in order to have the upper flange 17 of casing 16 located as near as possible above the lid 18 of the cistern. However, as the step of teeth 4 is about 15 mm, it may happen that the flange 17 is in a position as in FIG. 3 and that the lid is in position 18*a,* the gap between the two positions being H1. To make flange 17 move downwards by an elevation of H1, casing 16 must be rotated, which screws into the threaded sleeve 13. In its rotation, the casing drives socket 14 by keying symbolized at 35. Socket 14 screws into threaded ring 12, drawing along frame 25 in its downward motion. Casing 16 moves downward with thread pitch p1 and socket 14 moves downward with thread pitch p2, which is different from p1. Downward motion of casing 16 by an elevation of H1 causes downward motion of the abutment position 31, 32 by the same elevation H1. Downward motion of socket 14 by an elevation H2 different from H1 as thread pitch p2 is different from p1, causes axis 26 to move downwards by the same elevation H2. The number of screwing turns being the same for casing 16 and socket 14, elevations H1 and H2 are proportional to threads p1 and p2 respectively, with the same proportionality factor, giving the relationship:

$$H1/p1=H2/p2,$$

i.e.

$$H1/H2=p1/p2$$

Fingers 33 and 34 are fixed as their home position is defined by pre-adjustment of bracket 3 and by the fixed length of pull handles 8, 9. In order that swivelling arms 10, 11 remain in an effective position during downward motion of casing 16 and of socket 14, it is necessary that the centre of fingers 33, 34, the centre of axis 26 and abutment position 31, 32 remain aligned whichever the position of the casing during the downward motion. This condition is fulfilled if elevations H1 and H2 are in the same ratio as distances L1 and L2, i.e. if:

$$H1/H2=L1/L2$$

Putting together both above equations leads to the relationship $$p1/p2=L1/L2$$

According to the invention, thread pitches p1 and p2 of threads of casing 16 and of socket 14 are in the same ratio as distances L1 and L2.

Accordingly, when the position of casing 16 is changed so as to match the elevation of the ceramic lid of the cistern, the position of socket 14 is also changed in proportion of distances L1 and L2 in such a way that fingers 33, 34 remaining fixed, position of axis 26 is changed in such a way that heads 29, 30 of swivelling arms 10, 11 remain in abutment at contact positions 31, 32 under rods 21, 22.

As a result, there is no need to change the length of rods 21, 22 for providing adjustment of the flush mechanism according to the position of the cistern's lid.

According to the invention, the control button's position is independent of the position of the mechanism in the cistern, which enables the mechanism to be located in the most advantageous position in the cistern for making the float work properly on the one hand, and the button to be located at the most suitable position for the user on the other hand.

According to the invention, fitting of the flushing mechanism to the variable positions of the lid of the cistern is automatically provided by simply screwing therein casing 16.

Figure 4:
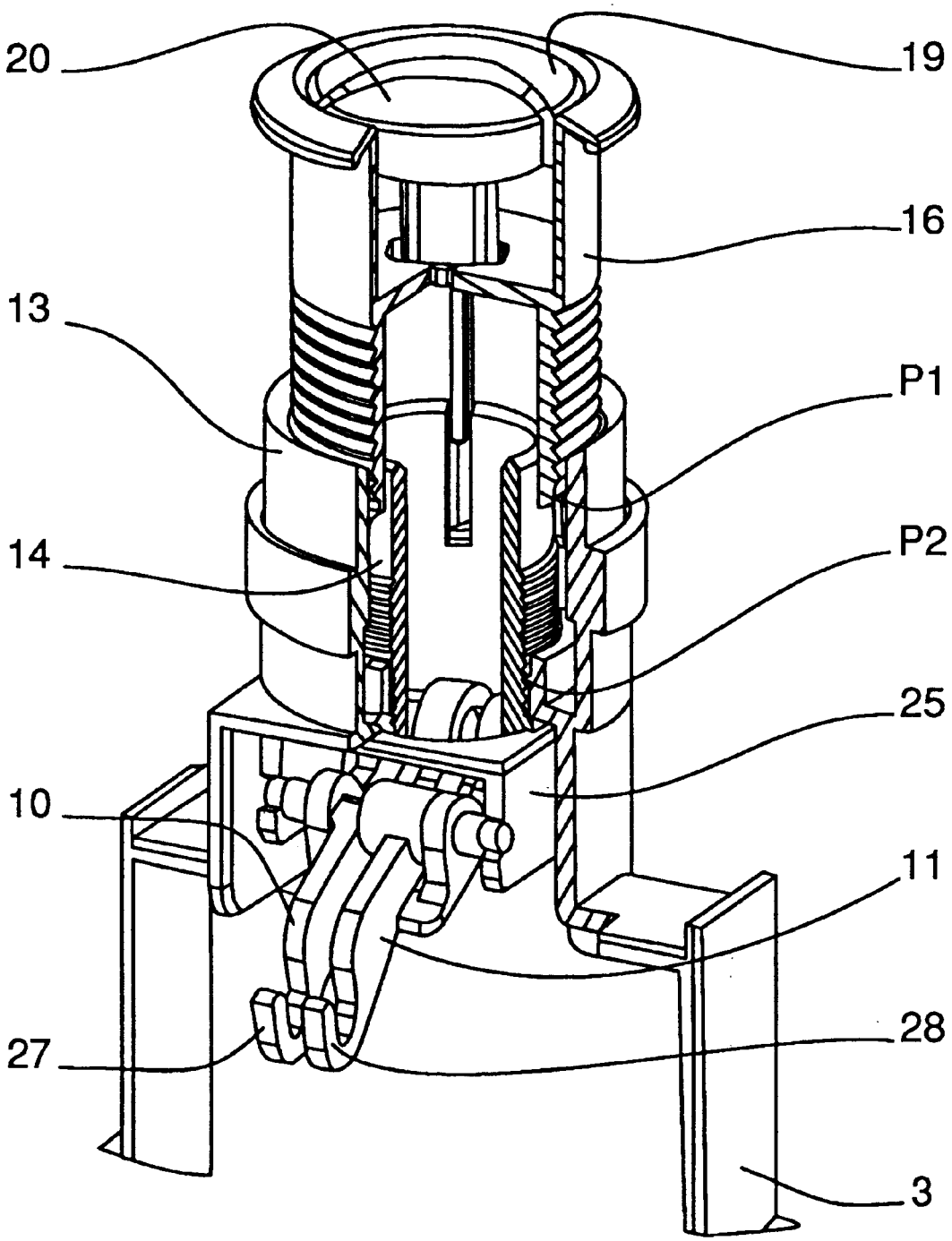
FIG. 4 is a perspective view of the device according to the invention after its removal.
Figure 5:
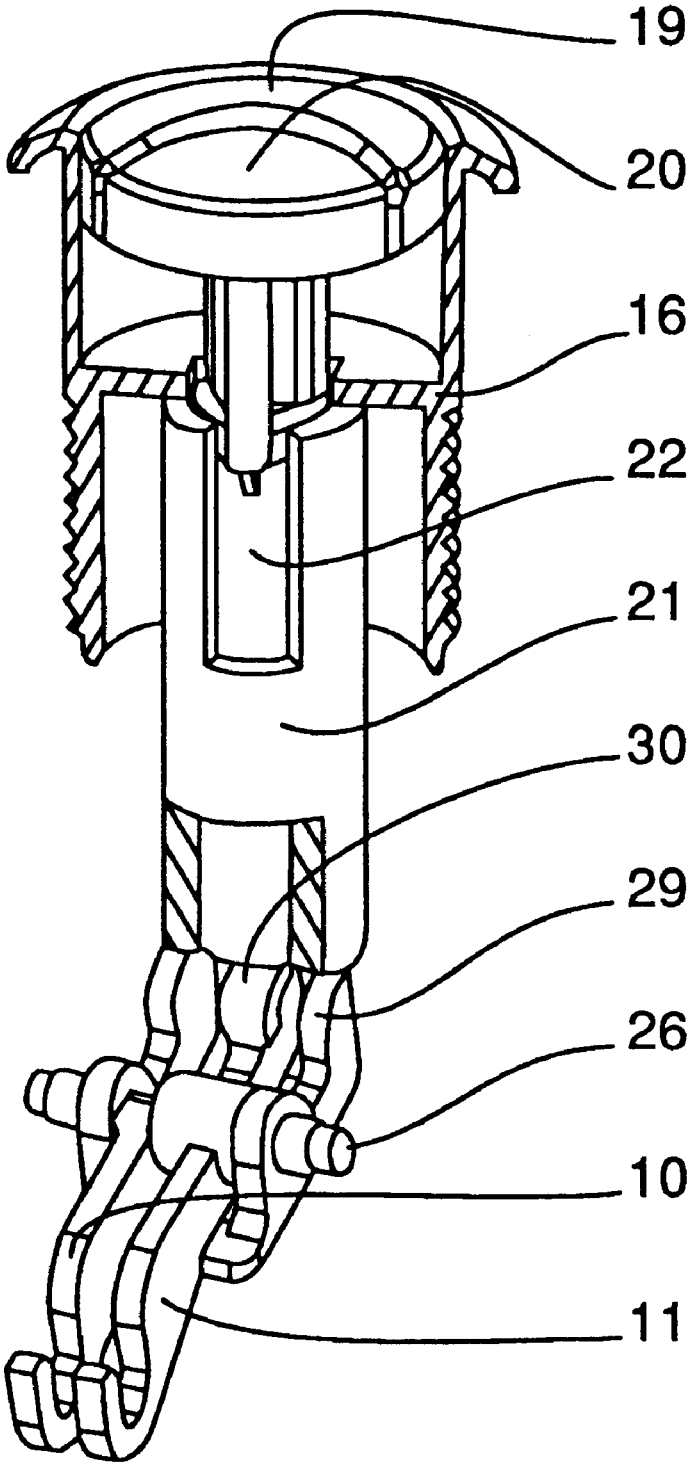
FIG. 5 is a similar view to FIG. 4, only showing the flush controls.

The relative positions of the different elements of the control device for a flushing mechanism according to the invention are better viewed in FIGS. 4 and 5.

The invention has been described for a particular embodiment, but it is not limited to a particular structure of the different constituent elements which may be replaced by their technical equivalents. Particularly it is applicable to the case of a flushing system with a single control.

Given that once the flushing mechanism is placed in the cistern, all that is needed is to proceed with the screwing in of the casing 16 to automatically adjust the control device, this device may justly be qualified as self-adjustable.

What is claimed is:

1. A self-adjustable device for controlling a cistern flushing mechanism comprising:

a bracket for supporting said flushing mechanism, said bracket having swivelling arms structured and arranged, by action on fingers provided by pull handles, to trigger the flushing;

rods acting on heads of the swivelling arms for controlling the flushing;

a casing including control buttons accessible from outside a lid of the cistern and having a thread of pitch p1 at its lower part;

a socket rotatably integral with said casing and having a thread of pitch p2;

a frame supported by said socket and supporting an axis of rotation of said swivelling arms;

said thread pitches p1 and p2 being determined in a ratio p1/p2=L1/L2 of vertical projections of distances L1 and L2 from the axis of said fingers to contact positions of said heads and of said rods, and to the axis of rotation of the swivelling arms;

said bracket supporting a threaded sleeve with thread pitch p1 and a threaded ring with thread pitch p2;

whereby screwing in of the casing until said casing rests against the cistern's lid automatically provides adjustment of the position of the axis of rotation and control of the flushing without adjustment of the length of the rods.

2. The device according to claim 1, wherein the socket is rotatably integral with the casing, by keying.

3. The device according to claim 1, wherein the frame is supported by the socket via a flange positioned at a lower part of the socket, said flange sliding upon rotation of the socket.

4. The device according to claim 1, wherein the casing bears at its upper part a flange for resting against the lid of the cistern.

* * * * *